US008434440B2

(12) United States Patent
Manther et al.

(10) Patent No.: US 8,434,440 B2
(45) Date of Patent: May 7, 2013

(54) SWITCHABLE FINGER LEVER

(75) Inventors: Debora Manther, Royal Oak, MI (US); Jeff Villemure, Eastpointe, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 335 days.

(21) Appl. No.: 12/802,109

(22) Filed: May 28, 2010

(65) Prior Publication Data

US 2011/0005483 A1 Jan. 13, 2011

Related U.S. Application Data

(60) Provisional application No. 60/217,539, filed on Jun. 1, 2009.

(51) Int. Cl.
*F01L 1/18* (2006.01)

(52) U.S. Cl.
USPC ..... 123/90.39; 123/90.16; 123/90.44

(58) Field of Classification Search ..... 123/90.16, 123/90.39, 90.41, 90.43–90.47
See application file for complete search history.

(56) References Cited

U.S. PATENT DOCUMENTS

| | | | | |
|---|---|---|---|---|
| 6,578,535 | B2 * | 6/2003 | Spath et al. | 123/90.16 |
| 6,769,387 | B2 * | 8/2004 | Hayman et al. | 123/90.39 |
| 6,976,461 | B2 * | 12/2005 | Rorig et al. | 123/90.16 |
| 7,934,477 | B2 * | 5/2011 | Elnick et al. | 123/90.16 |
| 8,132,551 | B2 * | 3/2012 | Manther | 123/90.44 |

* cited by examiner

*Primary Examiner* — Thomas Denion
*Assistant Examiner* — Daniel Bernstein
(74) *Attorney, Agent, or Firm* — Volpe and Koenig, P.C.

(57) ABSTRACT

A switchable finger lever for a valve train of an internal combustion engine, said finger lever comprising an inner lever comprising on an underside on one end, a support for a gas exchange valve and on another end, a contact surface for a head of a support element, said inner lever being flanked by outer arms which are articulated for pivoting relative to the inner lever on a side of the one end, at least each of said outer arms comprising on an upper side, a cam contacting surface, said inner lever comprising directly next to the contact surface a coupling device for an optional connection of the outer arms to the inner lever, said coupling device comprising a cross-bore in which two coupling slides are arranged diametrically opposite each other, which coupling slides for effecting coupling engage partially in or under an entraining surface arranged on the respective outer arm ending in this region, and the at least one restoring spring being likewise arranged in the region of the another end while being clamped between the inner lever and the outer arms.

15 Claims, 3 Drawing Sheets

SWITCHABLE FINGER LEVER

The present application claims the benefit of U.S. provisional application Ser. No. 61/217,539 filed Jun. 1, 2009.

FIELD OF THE INVENTION

The invention concerns a switchable finger lever for a valve train of an internal combustion engine, said finger lever comprising an inner lever comprising on an underside on one end, a support for a gas exchange valve and on another end, a contact surface for a head of a support element, said inner lever being flanked by outer arms which are connected to and pivotable relative to the inner lever, at least each of said outer arms comprising on an upper side, a cam contacting surface, said inner lever comprising a coupling device for connecting the outer arms to the inner lever, and at least one restoring spring being clamped between the inner lever and the outer arms.

BACKGROUND OF THE INVENTION

A drawback of the known prior art switchable finger levers is that they have a too solid structure and a too complicated design, while offering only restricted variability and possessing an excessively high mass moment of inertia. Thus, for instance, the outer arms of the prior art switchable levers are connected through crossbars, so that they have a box-like geometry which, in addition, is relatively complex from a manufacturing point of view. Moreover, important components such as restoring springs for the outer arms and/or a coupling device are positioned on the end situated at a distance from the fulcrum of the finger lever, and this has an important influence in raising the mass moment of inertia. Finally, it is noted that, if a coupling slide is used to connect two outer arms for effecting coupling, the coupling devices only offer an inadequate protection from switching errors.

OBJECT OF THE INVENTION

It is therefore an object of the invention to provide a switchable finger lever of the pre-cited type in which the aforesaid drawbacks are eliminated.

SUMMARY OF THE INVENTION

The invention achieves the above object by the fact that the outer arms are articulated on a side of the one end on the inner lever, the coupling device for an optional connection either of one of the outer arms or both outer arms simultaneously to the inner lever is situated directly next to the contact surface of the coupling device, this coupling device comprises a cross-bore in which two coupling slides are arranged diametrically opposite each other and which, for effecting coupling engage partially in or under an entraining surface arranged on the respective outer arm ending in this region, and the at least one restoring spring is likewise arranged in the region of the another end while being clamped between the inner lever and the outer arms.

In this way, a switchable finger lever is provided in which the aforesaid drawbacks are eliminated. The finger lever comprises a coupling device with a simple structure arranged in the region of the contact surface for the support element (transverse locking), in which region is likewise arranged the at least one restoring spring (lost motion spring) for the outer arms.

A further contribution towards a light construction is obtained, if according to one proposition of the invention, the outer arms are made separately. The crossbars of the prior art are dispensed with.

The separate outer arms enable, optionally, a three-step switching of the finger lever (zero lift/minimal lift-medium lift-full lift). Thus, in the case of a pressure chamber (pressure-less unlocking) being arranged at a central position in the cross-bore, one of the coupling slides can be contacted by a strong compression spring and the other coupling slide can be contacted by a compression spring weaker than said strong spring. During pressurizing of the pressure chamber with hydraulic medium in the cam base circle phase, that coupling slide is at first displaced to which the weaker compression spring is associated. The associated outer arm is then contacted, for instance, by a "medium lift cam", so that a "medium" valve lift is achieved. Upon further pressurization of the pressure chamber with hydraulic medium, the coupling slide to which the stronger compression spring is associated is also displaced, so that a full valve lift is obtained on the gas exchange valve.

On complete uncoupling of the outer arms, a minimal lift, for example, is generated on the inner lever through contact of a cam with a correspondingly low cam lobe. However, it is likewise conceivable and intended to let the inner lever be contacted by a so-called zero lift cam, so that a deactivation of a valve is also possible. If appropriate, the contact of a cam on the inner lever can be dispensed with.

In the case of two equally strong compression springs being installed in the cross-bore, the finger lever has the design of a so-called two-step lever. This enables a change-over between full lift/partial lift or full lift/zero lift.

An upper side of the inner lever may comprise, for instance, a low-cost sliding surface as a cam contact. However, it is likewise conceivable and intended to arrange a rolling bearing-mounted or a sliding bearing-mounted roller in a recess of the inner lever to serve as a cam contact.

The proposed transverse locking through two coupling slides on the another end of the finger lever has a simple structure and, due to being positioned directly next to the contact surface, it contributes to reducing the mass moment of inertia. Similarly, a coupling region of the coupling slides on the free ends of the outer arms has a simple design. Proposed is, for instance, a semi-shell-like cavity on each outer arm (cylindrical profile, gothic profile etc.) under which, for achieving coupling, the coupling slide can be displaced with its smaller diameter step. As engagement region for the respective coupling slide on the outer arm, it is, however, possible to use a bore or a flat. In case of a flat, the contact region of the coupling slide can likewise have a flat configuration.

For mounting the outer arms on the one end, it is conceivable and proposed to use, among outer things, axle stubs projecting outwards from the inner lever. It is, however, also possible to arrange a continuous axle in this region.

The invention includes two designs of the coupling device. According to a first variant, as set forth above, the coupling pistons are displaced into their coupling position by hydraulic medium pressure, whereas uncoupling is realized through the force of compression springs. In the second variant, the coupling pistons are displaced in coupling direction by compression spring force and through hydraulic medium pressure in uncoupling direction. Conceivable and proposed is also to load them in both directions by hydraulic medium or to displace them in at least one direction through electromagnetic loading.

In the case of the two-step configuration of the switchable finger lever, coupling through the two coupling slides which can be displaced outwards on both sides offers a good protection from switching errors. Thus, a high cam lift is transmitted even if only one of the coupling slides is displaced outwards.

According to a further feature of the invention, a stop in the form of a snap ring or the like is arranged in an annular groove in the region of a center of the cross-bore. In their retracted position, the coupling slides come to a standstill against this stop. At the same time, a minimal volume of the pressure chamber is guaranteed for the hydraulic medium.

As already described above, the at least one restoring spring for the outer arms also extends in the region of the another end, so that a further contribution to reducing the mass moment of inertia is made. In a further development of the invention, it is proposed to use two torsion leg springs, with exactly one torsion leg spring cooperating with one outer arm.

A simple mounting of the torsion leg springs is realized if these extend with their coil assembles on axle stubs protruding laterally from the another end of the inner lever. For reducing friction work, the invention further proposes to configure the flanks of the second legs in mesh with the support of the respective outer arm so as to correspond at least partially to an involute toothing of gearwheel teeth in mesh with each other. It is clear that a sliding-free rolling contact cannot be achieved at every point of contact. However, the person skilled in the art should optimize the meshing region such that push-type sliding is minimized.

As a contact surface of the inner lever for the support element may be used, for instance, a semi-spherical cavity. Through this cavity, hydraulic medium can be routed via a branch channel into the pressure chamber of the cross-bore, which hydraulic medium, during operation of the finger lever, is made available out of a head of the support element.

BRIEF DESCRIPTION OF THE DRAWING

The invention is described more closely in the following with reference to the appended drawing in which the figures show.

DETAILED DESCRIPTION OF THE DRAWING

Figure 1:
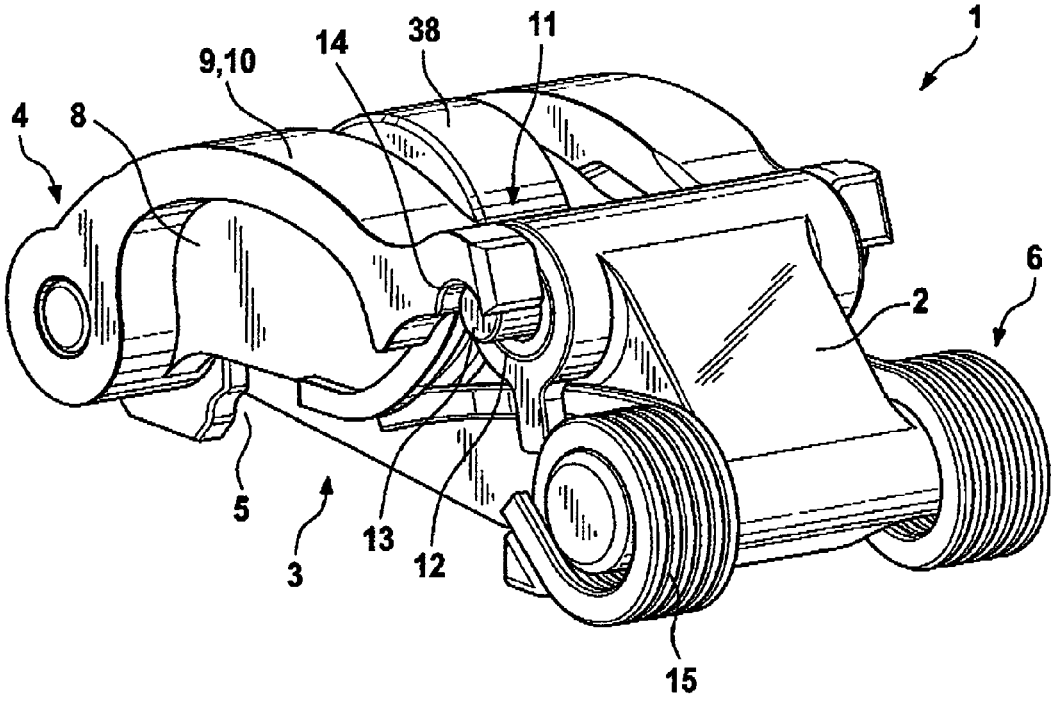
FIG. 1, a three-dimensional view of a finger lever of the invention, seen from the another end.

The figures illustrate a switchable finger lever 1 for a valve train of an internal combustion engine. The finger lever 1 comprises an elongate inner lever 2 flanked on each side by an outer arm 8. Both outer arms 8 are articulated in the region of one end 4 on the inner lever 2.

On an underside 3, the inner lever 2 comprises in the region of the one end 4 a support 5 for a gas exchange valve. In the region of another end 6, the inner lever 2 comprises a contact surface 7 configured in the present case in the form of a semi-spherical cavity for mounting a head of a support element.

Figure 2:
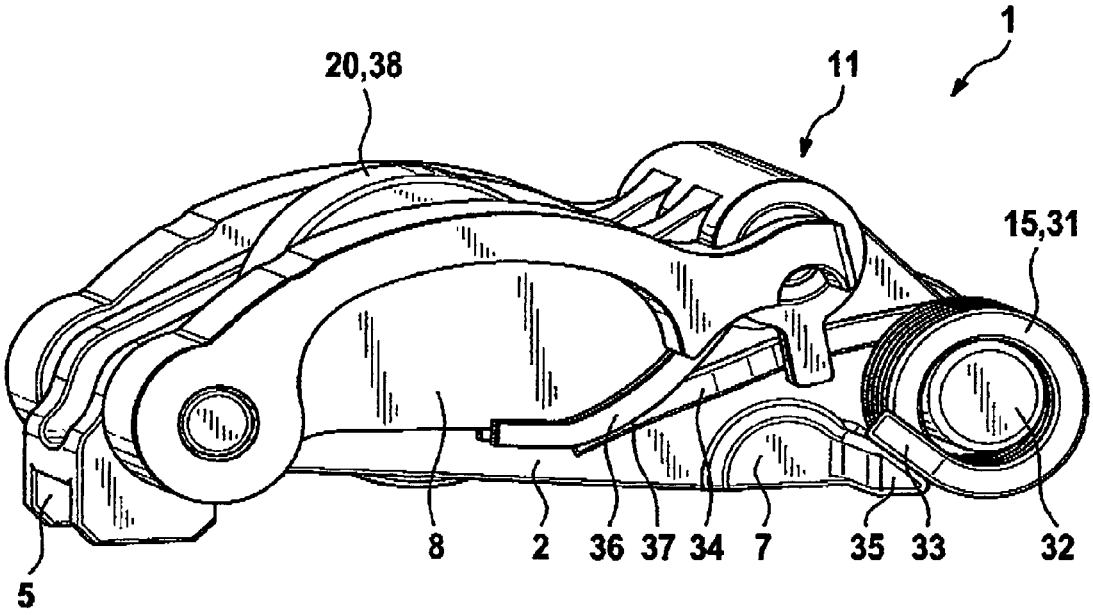
FIG. 2, a three-dimensional view of the finger lever of FIG. 1, in a viewing direction on its longitudinal sides, and FIG. 3, a cross-section through the finger lever in the region of its cross-bore.

As can be seem in FIGS. 1 and 2, a cam contacting surface 10 configured as a sliding surface is arranged on an upper side of 9 of each outer arm 8. In the inner lever 2, in contrast, is arranged a cam contacting surface 38 which is configured as a rotating roller and protrudes slightly beyond an upper side 20 of the inner lever 2.

In the region of the another end 6, the finger lever 1 comprises a cross-bore 12 arranged near the contact surface 7. Two coupling slides 13 extend in the cross-bore 12 while being situated diametrically opposite each other. Each coupling slide 13 has a two-step configuration and comprises an axially inner large diameter step 22 and an axially outer diameter step 23 that is smaller than the large diameter step 22. Both axially inner diameter steps 22 extend directly in the cross-bore 12. In the coupled state, the respective outer diameter steps 23 engage under an entraining surface 14 configured as a semi-shell-like cavity on the underside 30 of each outer arm 8.

Figure 3:
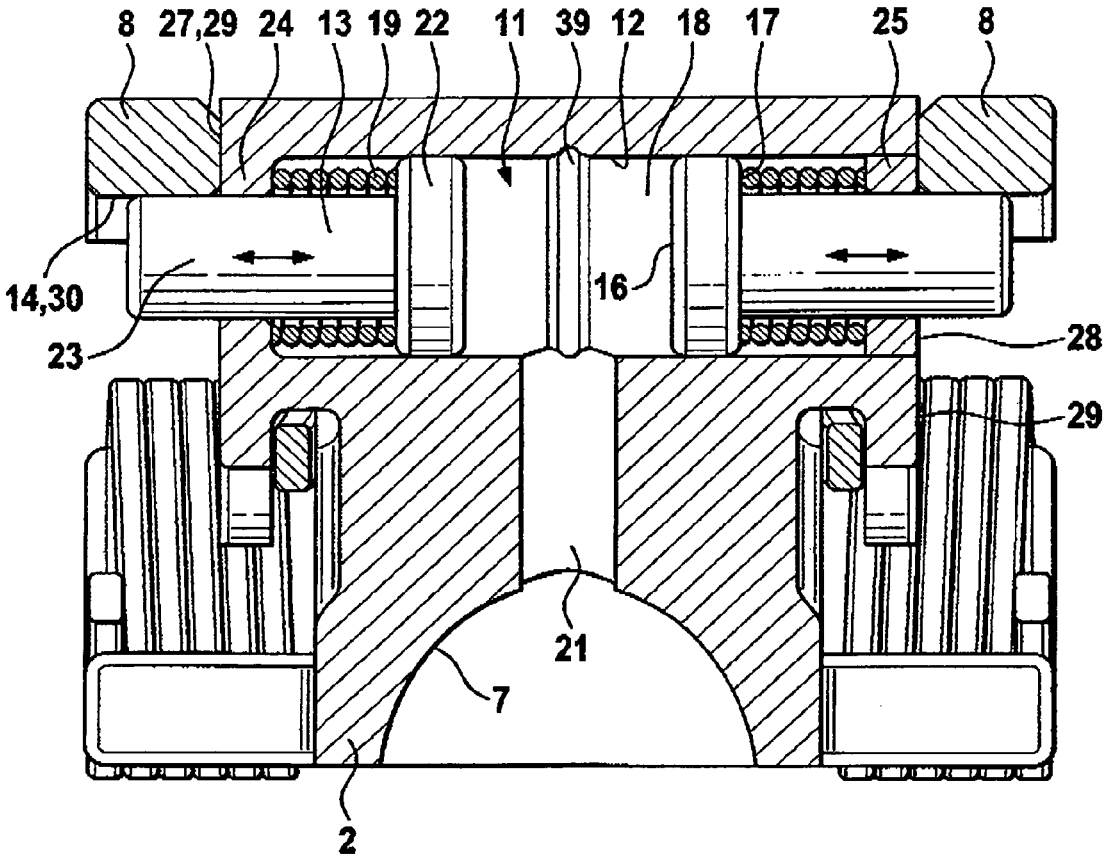

The coupling slide 13 shown on the left in FIG. 3 is guided by an annular step 24 extending integrally from the inner lever 2. The right-hand coupling side 13, in contrast, extends through a separate annular step 25 configured in the form of a plug. Inner front ends 16 of the coupling slides 13 define a pressure chamber 18 for the coupling device 11. A supply of hydraulic medium to the pressure chamber 18 is effected through a branch channel 21 starting from the contact surface 7.

In opposite direction to the hydraulic medium pressure (uncoupling direction), each coupling slide 13 is loaded through the force of a compression spring 19. Each compression spring 19 is supported axially inside on a front end 17 of the respective coupling slide 13 between the diameter steps 22, 23. Axially outside, the compression springs 19 act against respective inner sides of the annular steps 24, 25.

Directly on the another end 6 of the inner lever 2, two axle stubs 32 protrude sideward. A restoring spring 15 configured as a torsion leg spring is seated through its coil assembly 31 on each axle stub 32. A first, outer leg 33 of each restoring spring 15 acts against an upper side of a stop 35 protruding laterally from the inner lever 2. A second, inner leg 34 of each restoring spring 15 acts against a support 36 on the underside 30 of the corresponding outer arm 8. Flanks of the second legs 34 in mesh with the support 36 correspond at least partially to an involute toothing of gearwheel teeth in mesh with each other.

FIGS. 1, 3 show the coupled state of the finger lever 1, in which the finger lever 1 follows a lift of the high lift cams which act on the cam contacting surfaces 10 of its outer arms 8. For realizing this coupled position, hydraulic medium is routed through the branch channel 21 into the pressure chamber 18, so that, in the cam base circle phase, the coupling slides 13 are displaced in opposition to the force of their compression springs 19, under their entraining surfaces 14 on the outer arms 8.

When the hydraulic medium pressure is shut off, the coupling slides 13 are displaced during the cam base circle phase through the force of their compression springs 19 out of contact with their entraining surfaces 14 in the outer arms 8, so that the outer arms 8 swing without load and the finger lever 1 follows only the lift of the low-lift cam which contacts the inner lever 2.

If the compression springs 19 in the cross-bore 12 are designed with different strengths from each other, the finger lever 1 can be switched to three different valve lifts. For example, if the force of the compression spring 19 illustrated on the left is weaker than the force of the right-hand compression spring 19, upon pressurization of the pressure chamber 18 by hydraulic medium, the left-hand coupling slide 13 is the first to move into the coupling position. As a result, the finger lever 1 follows, for example, only a "medium-lift cam" which loads the left outer arm 8. Upon further pressurization of the pressure chamber 18, the coupling slide 13 with the stronger compression spring 19 illustrated on the right in FIG. 3 is also displaced outwards into the coupling position, so that the finger lever 1 then follows a high-lift cam which contacts the right outer arm 8 as shown in FIG. 3.

An uncoupling of the outer arms 8 is achieved through a stepwise reduction of the hydraulic medium pressure in the pressure chamber 18, needing no further specification here.

The invention claimed is:

1. A switchable finger lever for a valve train of an internal combustion engine, said finger lever comprising an inner lever comprising on an underside on a first end, a support for a gas exchange valve and on a second end, a contact surface for a head of a support element, said inner lever being flanked by outer arms which are articulated for pivoting relative to the inner lever on a side of the first end, at least each of said outer arms comprising on an upper side, a cam contacting surface, said inner lever comprising directly next to the contact surface a coupling device for an optional connection either of at least one of the outer arms or both outer arms simultaneously to the inner lever, said coupling device comprising a cross-bore in which two coupling slides are arranged diametrically opposite each other, said coupling slides, for effecting coupling engage partially in or under an entraining surface arranged on the respective outer arm ending in this region, and at least one restoring spring being likewise arranged at the second end while being clamped between the inner lever and the outer arms.

2. The finger lever according to claim 1, wherein for displacement of the coupling slides in one direction, a pressure chamber for hydraulic medium is formed in front of a first end of the coupling slides, which hydraulic medium is routable via the contact surface out of the head of the support element, and for displacement of the coupling slides in an opposite direction, at least one compression spring/one compression spring assembly acts against a second end of the coupling slides.

3. The finger lever according to claim 2, wherein, one compression spring/compression spring assembly is provided per coupling slide, and the compression springs/compression spring assemblies of the coupling slides are identical.

4. The finger lever according to claim 3, wherein the cam contacting surfaces of the outer arms are configured for a contact by high lift cams.

5. The finger lever according to claim 2, wherein the pressure chamber is arranged centrally in the cross-bore in front of the first ends which are inner ends of the coupling slides and is intersected by a branch channel for the hydraulic medium out of the contact surface, wherein each of the coupling slides comprises an axially inner diameter step which bears with an outer peripheral surface against the cross-bore and an axially outer diameter step of smaller diameter than the axially inner diameter step, with said smaller diameter step the coupling slide is guided through an axially outer annular step of the cross-bore, and between said outer annular step and an annular stop between the diameter steps of the coupling slide the compression spring/compression spring assemblies is seated.

6. The finger lever according to claim 5, wherein a center stop comprising a ring element or a pin is arranged in the cross-bore and serves to limit an inward displacement of the coupling slide.

7. The finger lever according to claim 1, wherein the entraining surfaces of the outer arms are configured as one of semi-shell-like cavities, quarter-shell-like cavities, bores or flats on undersides of the outer arms.

8. The finger lever according to claim 1, wherein the outer arms are made as separate parts from each other.

9. The finger lever according to claim 1, wherein the cam contacting surfaces of the outer arms are configured as sliding surfaces and the cam contacting surface is configured on an upper side of the inner lever, this cam contacting surface is configured as one of a sliding surface or a rolling bearing-mounted roller or a sliding bearing-mounted roller.

10. A switchable finger lever for a valve train of an internal combustion engine, said finger lever comprising an inner lever comprising on an underside on a first end, a support for a gas exchange valve and on a second end, a contact surface for a head of a support element, said inner lever being flanked by outer arms which are articulated for pivoting relative to the inner lever on a side of the one end, at least each of said outer arms comprising on an upper side, a cam contacting surface, said inner lever comprising directly next to the contact surface a coupling device for an optional connection either of at least one of the outer arm s or both outer arms simultaneously to the inner lever, said coupling device comprising a cross-bore in which two coupling slides are arranged diametrically opposite each other, said coupling slides, for effecting coupling engage partially in or under an entraining surface arranged on the respective outer arm ending in this region, and the at least one restoring spring being likewise arranged at the second end while being clamped between the inner lever and the outer arms, wherein for displacement of the coupling slides in one direction, a pressure chamber for hydraulic medium is formed in front of a first end of the coupling slides, which hydraulic medium can be routed via the contact surface out of the head of the support element, and for displacement of the coupling slides in an opposite direction, at least one compression spring/one compression spring assembly acts against a second end of the coupling slides wherein, one compression spring/compression spring assembly is provided per coupling slide, and the compression springs/compression spring assemblies of the two coupling slides have different spring forces.

11. The finger lever according to claim 10, wherein, the pressure chamber is configured in front of the first ends which are inner ends of the coupling slides for a hydraulic displacement of the coupling slides in a coupling direction, and the cam contacting surface of the outer arm on a side of a stronger one of the compression springs/compression spring assemblies serves for a contact for a high lift cam, whereas the cam contacting surface of the outer arm on a side of a weaker one of the compression springs/compression spring assemblies serves as a contact for a medium lift cam, and an upper side of the inner lever serves for a contact for a zero lift cam or a low lift cam.

12. The finger lever according to claim 10, wherein, the pressure chamber is configured in front of the second ends which are outer ends of the coupling slides for a hydraulic displacement of the coupling slides in an uncoupling direction, and the cam contacting surface of the outer arm on a side of a weaker one of the compression springs/compression spring assemblies serves for a contact for a high lift cam, whereas the cam contacting surface of the outer arm on a side of a stronger one of the compression springs/compression spring assemblies serves as a contact for a medium lift cam, and an upper side of the inner lever serves for a contact for a zero lift cam or a low lift cam.

13. A switchable finger lever for a valve train of an internal combustion engine, said finger lever comprising an inner lever comprising on an underside on a first end, a support for a gas exchange valve and on a second end, a contact surface for a head of a support element, said inner lever being flanked by outer arms which are articulated for pivoting relative to the inner lever on a side of the one end, at least each of said outer arms comprising on an upper side, a cam contacting surface, said inner lever comprising directly next to the contact surface a coupling device for an optional connection either of at least one of the outer arms or both outer arms simultaneously to the inner lever, said coupling device comprising a cross-bore in which two coupling slides are arranged diametrically opposite each other, said coupling slides, for effecting coupling engage partially in or under an entraining surface arranged on the respective outer arm ending in this region, and the at least one restoring spring being likewise arranged at the second end while being clamped between the inner lever and the outer arms, wherein the cross-bore comprises an annular step on both sides, outer front ends of said annular steps are at least substantially flush with longitudinal sides of the inner lever and one annular step on one side is an integral part of the inner lever and the other annular step on the other side is a separate plug.

14. A switchable finger lever for a valve train of an internal combustion engine, said finger lever comprising an inner lever comprising on an underside on a first end, a support for a gas exchange valve and on a second end, a contact surface for a head of a support element, said inner lever being flanked by outer arms which are articulated for pivoting relative to the inner lever on a side of the one end, at least each of said outer arms comprising on an upper side, a cam contacting surface, said inner lever comprising directly next to the contact surface a coupling device for an optional connection either of at least one of the outer arms or both outer arms simultaneously to the inner lever, said coupling device comprising a cross-bore in which two coupling slides are arranged diametrically opposite each other, said coupling slides, for effecting coupling engage partially in or under an entraining surface arranged on the respective outer arm ending in this region, and the at least one restoring spring being likewise arranged at the second end while being clamped between the inner lever and the outer arms, wherein two restoring springs configured as torsion leg springs are arranged on the another end, a coil assembly of each of the torsion leg springs is seated on an axle stub which protrudes in a region of the second end from a longitudinal side of the inner lever, wherein a first leg and a second leg extends away from each of the coil assemblies, said first leg is clamped against a stop of the inner lever and said second leg is clamped against a support of the underside of the respective outer arm.

15. The finger lever according to claim 14, wherein flanks of the second legs in mesh with the support of the respective outer arm correspond at least partially to an involute toothing of gearwheel teeth in mesh with each other.

* * * * *